US008424680B2

(12) United States Patent
Fair et al.

(10) Patent No.: US 8,424,680 B2
(45) Date of Patent: Apr. 23, 2013

(54) CAMERA CASE WITH SELECTIVE LENS STORAGE

(75) Inventors: Paul Fair, Denver, CO (US); Josh Buller, New York, NY (US)

(73) Assignee: Thule Organization Solutions, Inc., Longmont, CO (US)

( * ) Notice: Subject to any disclaimer, the term of this patent is extended or adjusted under 35 U.S.C. 154(b) by 826 days.

(21) Appl. No.: 12/345,109

(22) Filed: Dec. 29, 2008

(65) Prior Publication Data

US 2009/0266727 A1 Oct. 29, 2009

Related U.S. Application Data

(60) Provisional application No. 61/047,904, filed on Apr. 25, 2008.

(51) Int. Cl.
*B65D 85/38* (2006.01)

(52) U.S. Cl.
USPC ..... 206/316.2; 206/316.1; 206/316.3; 206/523; 206/592; 224/908; 150/113; 190/110

(58) Field of Classification Search ..... 206/316.1, 206/316.2, 316.3, 523, 592; 150/113; 190/110; 224/908
See application file for complete search history.

(56) References Cited

U.S. PATENT DOCUMENTS

| | | | | | |
|---|---|---|---|---|---|
| 2,290,307 | A | | 7/1942 | Wicker | |
| 2,691,401 | A | * | 10/1954 | Kontoff et al. | 206/316.1 |
| 4,000,769 | A | * | 1/1977 | Katz | 206/316.2 |
| D252,539 | S | * | 8/1979 | Cohee | D3/267 |
| 4,172,485 | A | * | 10/1979 | Mathieu | 206/316.2 |
| 4,210,186 | A | * | 7/1980 | Belenson | 206/316.2 |
| 4,260,004 | A | * | 4/1981 | Domke | 206/316.2 |
| 4,549,589 | A | * | 10/1985 | Nguyen | 206/316.2 |
| 4,601,318 | A | | 7/1986 | Diegelman | |
| 4,620,579 | A | * | 11/1986 | Lowe et al. | 206/316.2 |
| 4,671,992 | A | * | 6/1987 | Lancaster et al. | 428/316.6 |
| 5,205,448 | A | | 4/1993 | Kester et al. | |
| 5,217,119 | A | | 6/1993 | Hollingsworth | |
| 5,240,106 | A | * | 8/1993 | Plath | 206/316.2 |
| 5,356,004 | A | | 10/1994 | Weinreb | |
| 5,423,404 | A | * | 6/1995 | Shaw | 190/102 |
| 5,775,496 | A | | 7/1998 | Cyr | |
| 6,047,752 | A | | 4/2000 | Southwick | |
| 6,070,776 | A | | 6/2000 | Furnary et al. | |
| 6,105,764 | A | | 8/2000 | Scichana | |
| 6,121,877 | A | * | 9/2000 | Johnson et al. | 340/571 |

(Continued)

OTHER PUBLICATIONS

Case Logic 2006 Catalog, pp. 7 & 8.

(Continued)

*Primary Examiner* — J. Gregory Pickett
*Assistant Examiner* — Blaine Neway
(74) *Attorney, Agent, or Firm* — Sheridan Ross P.C.

(57) ABSTRACT

A camera storage case is provided that includes a camera support system. The camera support system may be made of EVA foam and made to conform to the exterior perimeter surface of the camera. The camera support system may also include a tube to protect the camera's interconnected lens. The storage case can be configured as a backpack, messenger bag, or holster. Flexible lens holders are included in the storage case to facilitate easy access to stored lenses. Furthermore, the storage case provides dividing walls to allow the user to selectively configure the interior storage compartment of the camera case.

20 Claims, 26 Drawing Sheets

U.S. PATENT DOCUMENTS

| | | | | |
|---|---|---|---|---|
| 6,305,537 | B1 | 10/2001 | Jaffe | |
| 6,516,751 | B2 | 2/2003 | Burns et al. | |
| 7,048,103 | B2 * | 5/2006 | Hollingsworth | 190/117 |
| 7,959,048 | B1 * | 6/2011 | Cyr | 224/651 |
| 2005/0248913 | A1 | 11/2005 | Hassett et al. | |
| 2006/0283737 | A1 * | 12/2006 | Hassett | 206/316.2 |
| 2007/0051645 | A1 * | 3/2007 | Hassett | 206/316.2 |

OTHER PUBLICATIONS

Case Logic 2003 Catalog, pp. 18, 20, 21 & 22.
Case Logic 1999 Catalog, pp. 20-22.
Ambico, Video Luggage & Photo cases, pp. 2-5, date unknown.
Samsonite German Language Catalog, p. 180, date unknown.
Lowepro 2000 Catalog, pp. 15, 17, 27, 29, 31, 33, 41 & 43.
Tamrac 20th Anniversary Catalog, pp. 10, 15, 22, 50 & 51.
Case Logic 2001 Catalog, pp. 35-37.
Official Action for U.S. Appl. No. 11/421,333, mailed Jan. 3, 2008.
Official Action for U.S. Appl. No. 11/421,333, mailed Jul. 21, 2008.
Official Action for U.S. Appl. No. 11/421,333, mailed Oct. 31, 2008.
Official Action for U.S. Appl. No. 11/421,333, mailed Jan. 27, 2009.

* cited by examiner

CAMERA CASE WITH SELECTIVE LENS STORAGE

CROSS REFERENCE TO RELATED APPLICATIONS

This patent application claims the benefit of 61/047,904, filed Apr. 25, 2008, which is incorporated by reference in its entirety herein.

FIELD OF THE INVENTION

Embodiments of the present invention are generally related to camera cases and the storage of sensitive electronic devices. More specifically, one embodiment of the present invention is a backpack that includes a camera storage area that employs a foam cradle adapted for supporting an SLR camera.

BACKGROUND OF THE INVENTION

Camera cases are commonly used to transport and store cameras. It is often necessary or desirable, however, to allow the user to gain access quickly to the stored camera and to provide additional storage space for camera accessories or other equipment.

Typically, photographers carry multiple camera accessories along with the camera. If the camera case is not sized to accommodate these accessories, they must be independently carried. However, if the camera and accessories are carried together, the carrying bag may become oversized and bulky, which makes the bag difficult to carry. Thus, it is important to provide a camera case that is lightweight and designed to carry the camera and multiple accessories in a rugged and compact space.

Although camera cases are generally known, they have conventionally been designed as utility bags that provide limited access to the interior. Typically, camera cases include a top or side opening for accessing the interior storage compartment. However, these camera cases do not ensure that the camera does not inadvertently move when the bag is opened which may cause potential damage to the delicate electronic componentry. Thus, it would be advantageous to provide a camera case that would maintain the camera in a fixed position within the case.

Moreover, typical camera cases are not efficiently designed to allow the removal and replacement of the stored camera. For example, a conventional utility bag shape that includes short handles or a shoulder strap limits the photographers ability to access the camera with one hand. That is, to access items stored in conventional camera cases, one must remove the case from their person, set the case down, and then gain access to the stored contents. Thus the photographer cannot quickly access the stored camera and associated accessories. It would be desirable to provide a camera case that allows easy access to the stored camera. Additionally, it would be beneficial to provide a camera case which also positions the camera so that it is easy to selectively remove and replace.

In addition, conventional camera cases require the photographer to use one or both hands to carry the camera case. This is undesirable if the photographer is also trying to carry other items or maneuver around objects. Thus it would be advantageous to provide a camera case capable of unobtrusively containing a camera and providing for hands-free carrying.

Furthermore, conventional camera cases have fixed compartments for accessories. Fixed compartments typically do not give a photographer much storage flexibility. For example, some compartments of traditional storage cases are sized for batteries, cords, and flashes but not for lenses. Some camera cases have attempted to provide adjustable compartments; however, such compartments are typically difficult to adjust, do not stay in place, or are not sized to accommodate accessories such as lenses. Thus, it would be desirable to provide a camera case that facilitates the storage of various camera accessories with multiple sizes and geometric shapes.

Cameras and other photographic equipment can be large, heavy and fragile and it is frequently necessary to provide a carrying case to protect them when they are carried. Cameras and their accessories are often carried in and out of cars, vans, buses, trains, airplanes, etc. and often to remote locations. Thus, it is important to have a camera case that adequately protects the contents stored. Moreover, it important to adequately protect the equipment because repairs can be very expensive. Damage to camera equipment while in a storage case is typically caused by the equipment not remaining in a fixed or semi-fixed position while the case is being moved or dropped. Typical camera cases are made from nylon, polyester, aluminum, or some combination thereof. Unfortunately, these materials are usually too rigid or not rigid enough to provide adequate protective storage. Thus, it would be advantageous to provide a camera case containing a molded, rigid support for a camera to maintain the camera in a relatively fixed position.

There is a long felt but unsolved need for a camera case that avoids the above-mentioned deficiencies of the prior art and provides a camera storage area with a molded support for a camera, positions the stored camera for easy removal, and accommodates multiple accessories with variable shapes such as lenses, and provides dividing walls within the storage case.

SUMMARY OF THE INVENTION

It is thus one aspect of the present invention to provide a camera storage area with a molded, rigid support for a single-lens reflex ("SLR") camera. Preferably, the molded support is made of ethylene-vinyl acetate (EVA) foam that possesses the general shape of SLR cameras. Thus it is contemplated that the EVA "cradle" will accommodate many brands of SLR cameras. One embodiment of the present invention additionally provides a cradle having a compliant material that conforms to a stored camera and that additionally provides shock protection. The cradle may also employ a tube extending therefrom that protects the SLR's interconnected lens. More specifically, it is envisioned that the cradle supports the camera in a lens-down orientation wherein the lens is located within a hole in the cradle, and wherein the tube protects the lens. The tube preferably has a length to accommodate lenses of various lengths. The tube may be rigid or compliant and may be selectively interconnected to the cradle for easy removal. Alternatively, the tube and cradle are of one-piece construction and are made of EVA foam.

It is another aspect of the present invention to provide a camera case that positions the stored camera for easy removal. Embodiments of the present invention are integrated into a backpack such that the cradle is positioned adjacent a top portion of the backpack. Thus a user can easily reach behind his or her head, gain access to the interior of the backpack, and grasp and remove the stored camera from the cradle for expedited image capture.

It is yet another aspect of the present invention to provide a storage case that selectively accommodates a plurality of lenses. More specifically, lens holders are included and selectively positioned within the case. The lens holders may be triangularly shaped so as to provide gaps that allow easy access to the stored lenses. The lens holders of embodiments of the present invention include hook and loop material and thus may be affixed to various locations in the interior portion of the camera case. The lens holders are preferably flexible and are designed to accommodate lenses of varying diameters in lengths.

It is another aspect of the present invention to provide a plurality of dividing walls within the storage case. One embodiment of the present invention employs a horizontally situated wall having a hole therethrough that receives the above-described tube extending from the cradle, and which provides additional lateral stability to the tube. A plurality of selectively adjustable walls which are vertically-oriented, horizontally-oriented, or a combination thereof are provided that allow the user to selectively allow the storage configuration of the camera case.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of these inventions.

Figure 1:
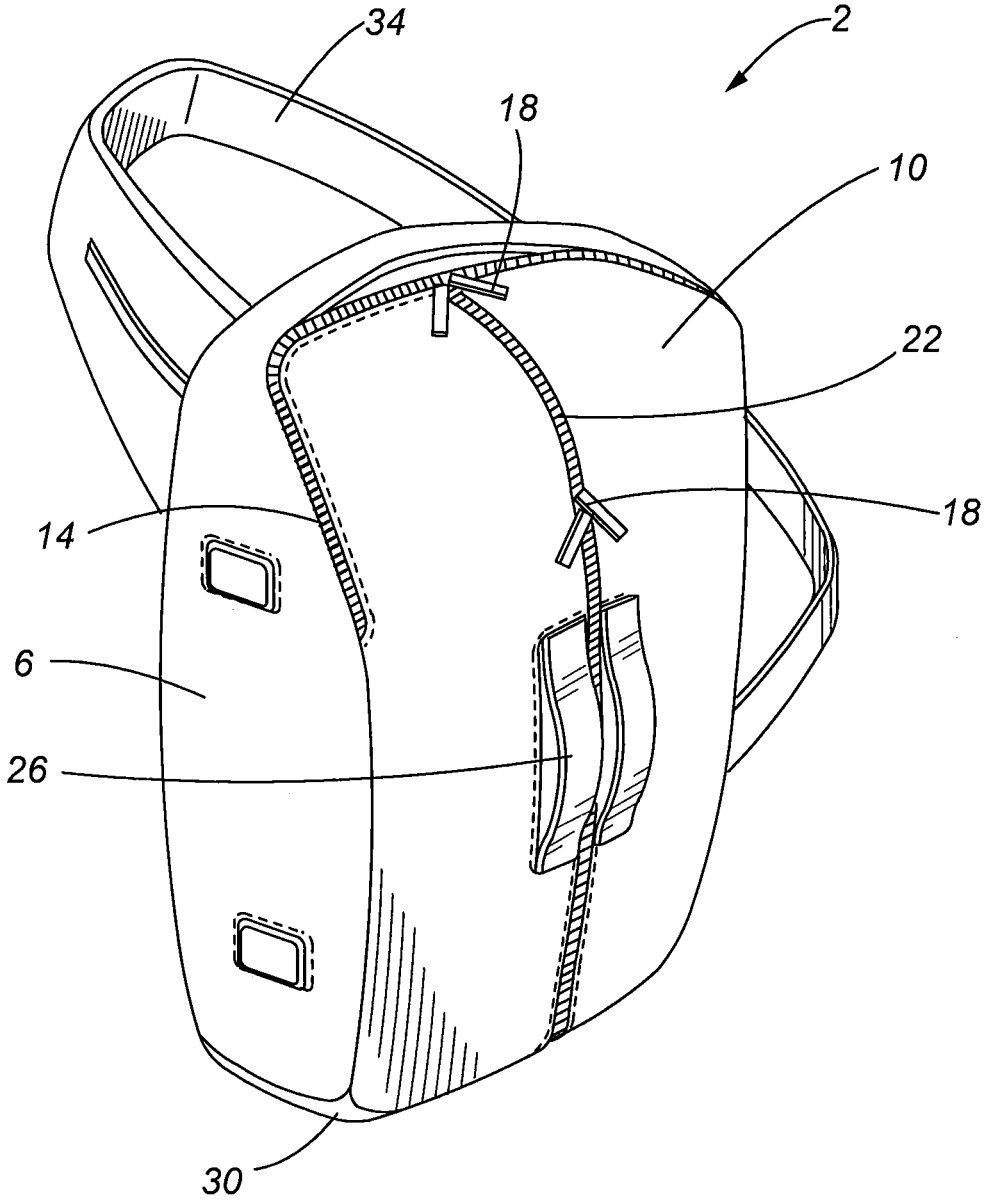
FIG. 1 is a perspective view of a camera case of one embodiment of the present invention that is integrated into a backpack.
Figure 2:
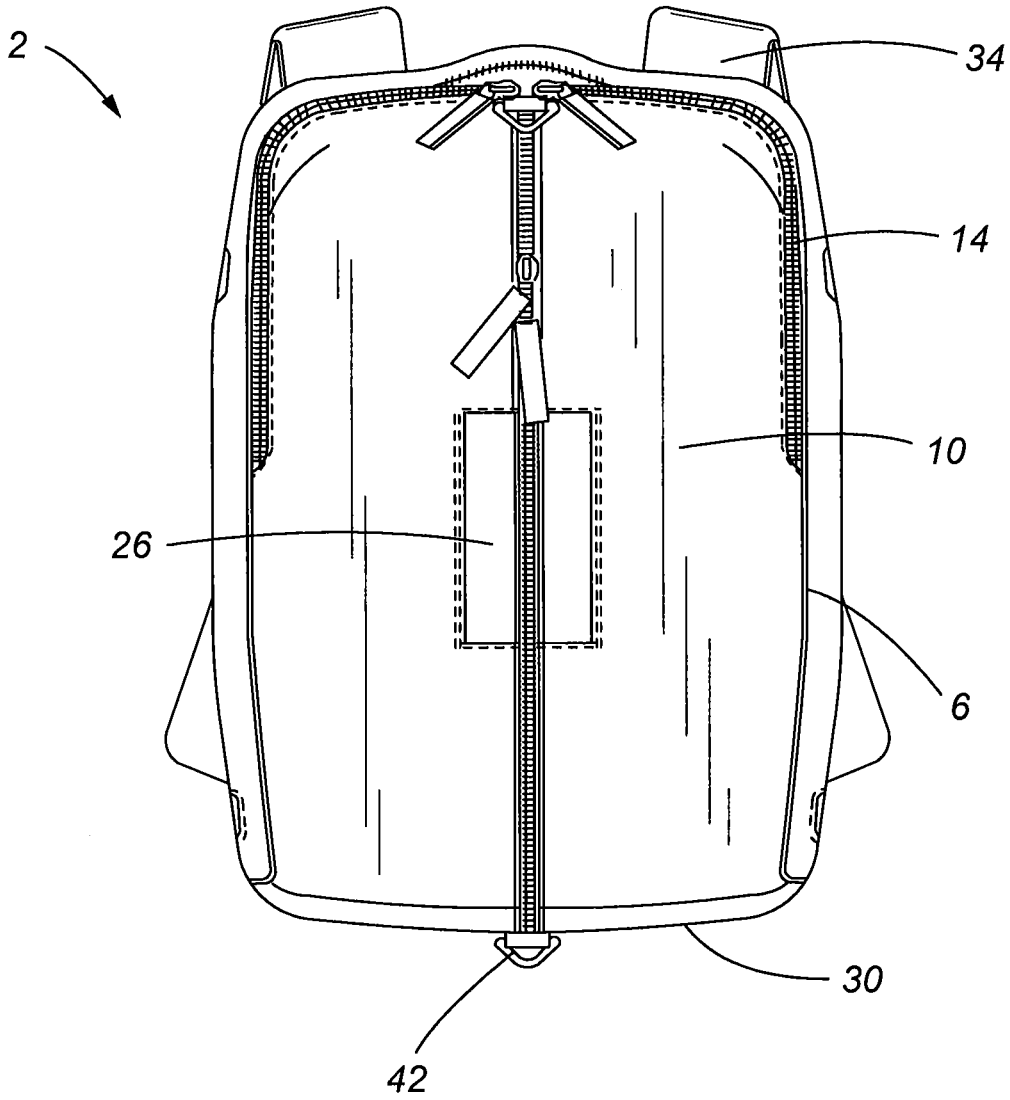
FIG. 2 is a front elevation view of FIG. 1.
Figure 3:
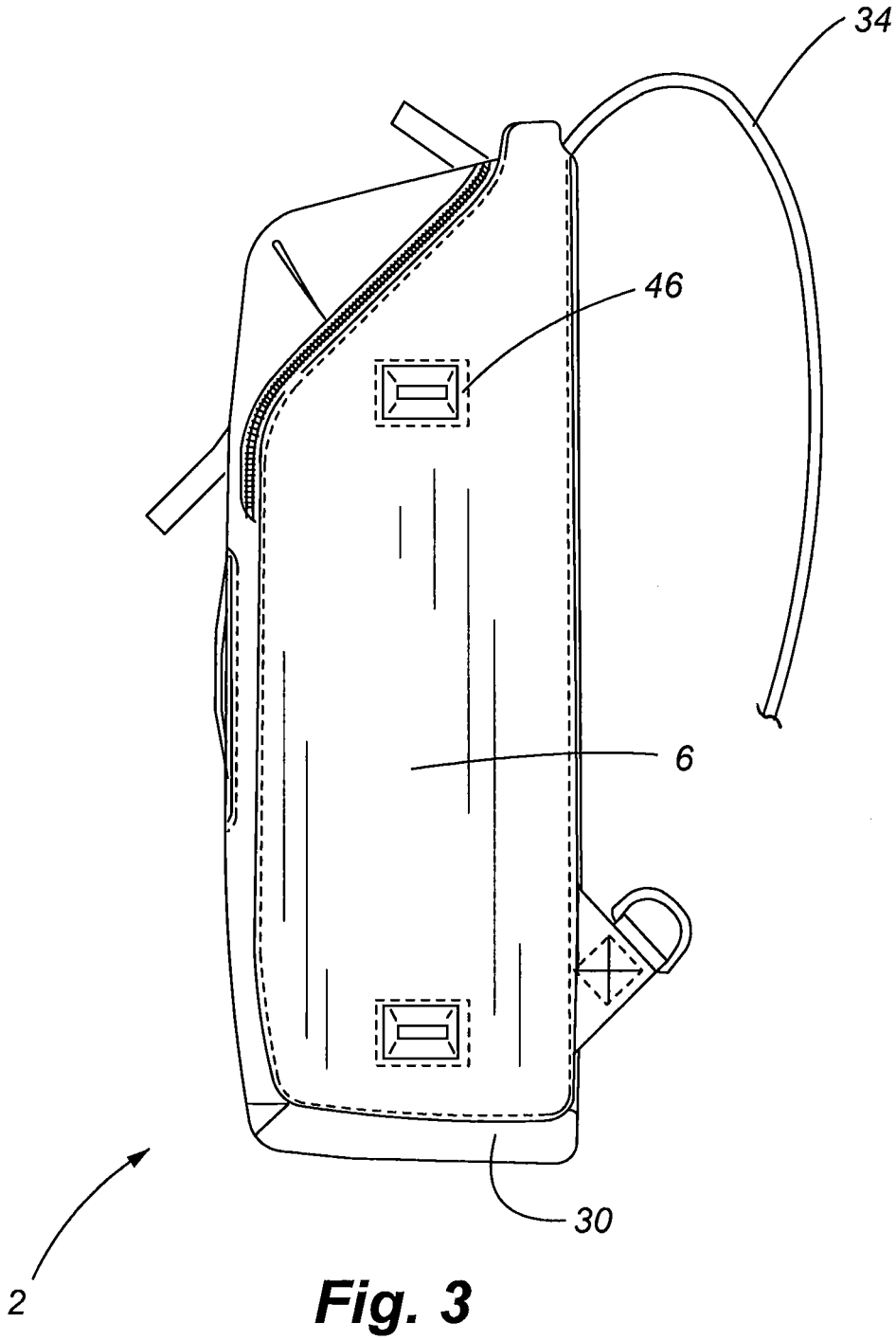
FIG. 3 is a side elevation of FIG. 1.
Figure 4:
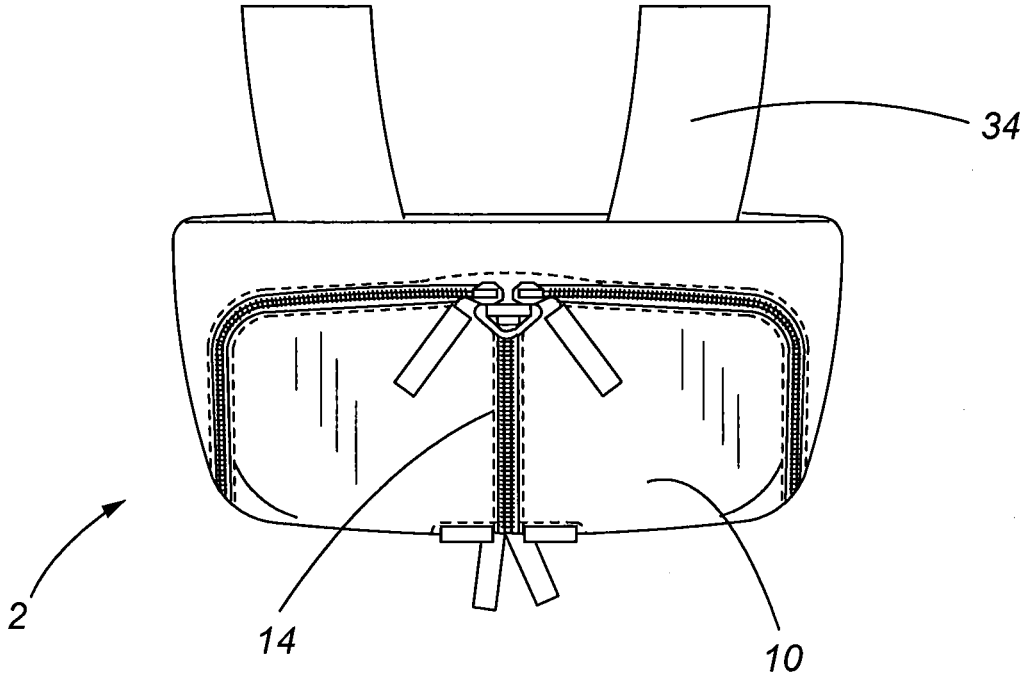
FIG. 4 is a top plan view of FIG. 1.
Figure 5:
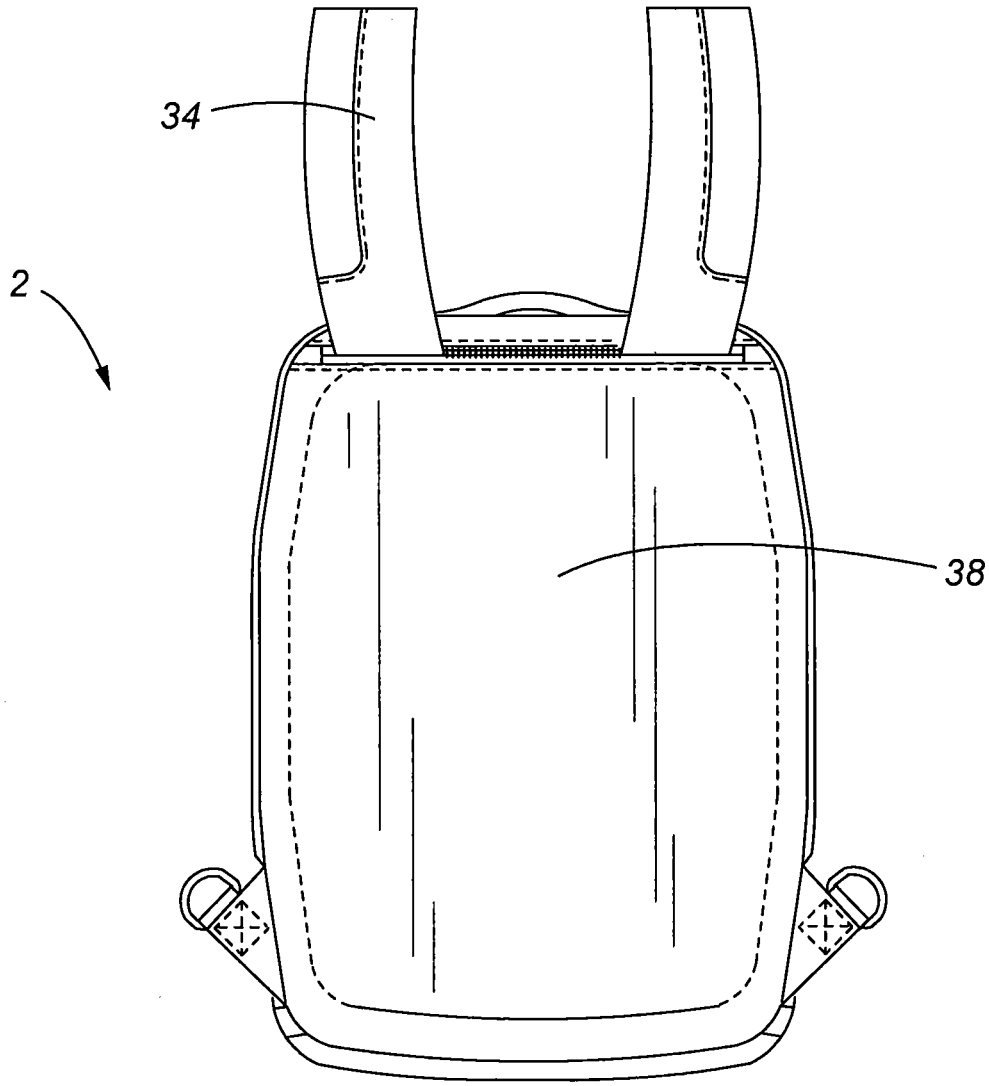
FIG. 5 is a rear elevation of FIG. 1.
Figure 6:
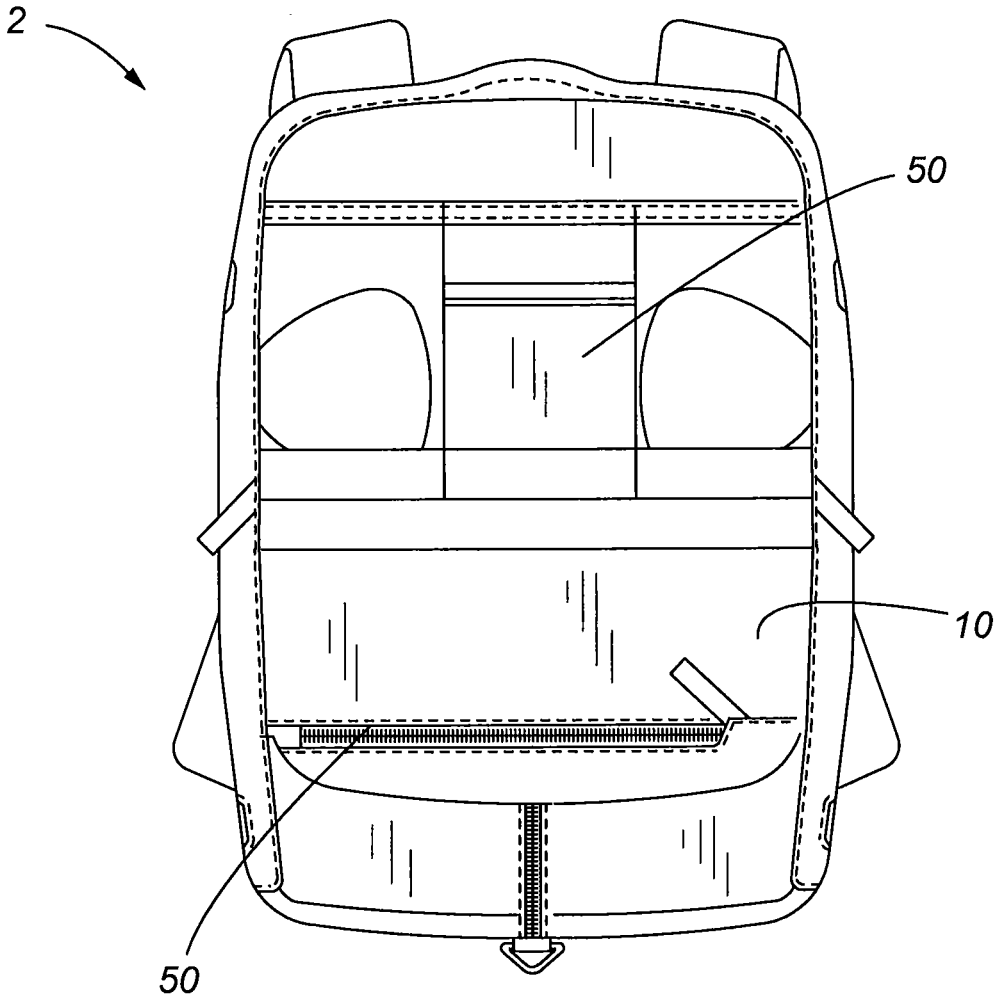
FIG. 6 is a front elevation of FIG. 1 wherein a front flap is opened.
Figure 7:
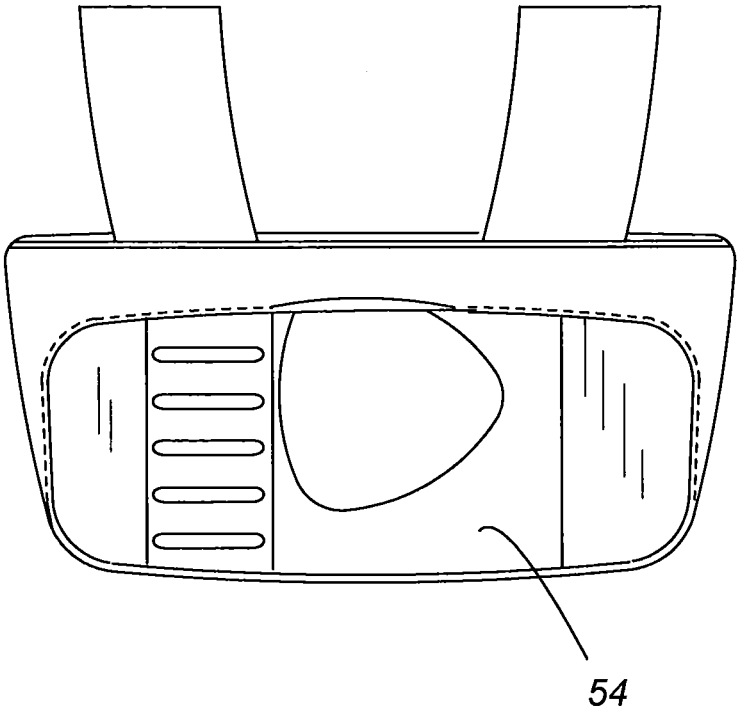
FIG. 7 is a top plan view of FIG. 1, showing a cradle.
Figure 8:
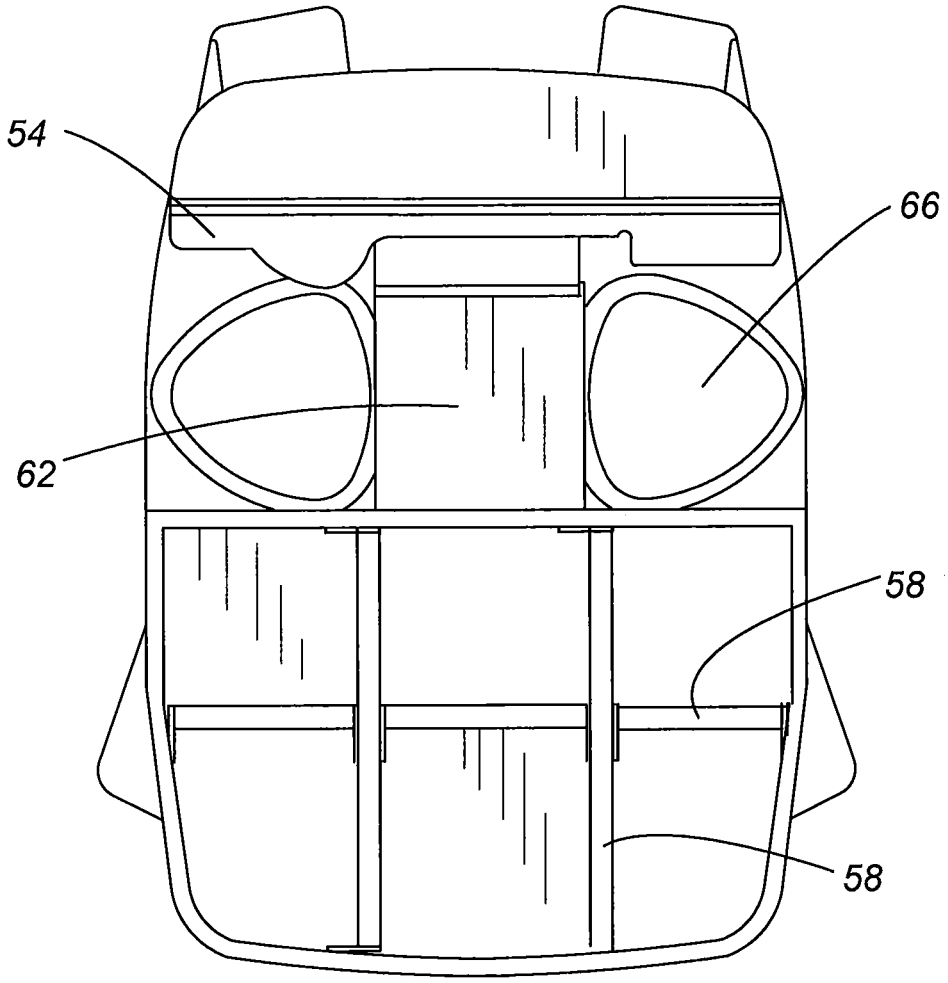
FIG. 8 is a front elevation view of FIG. 1 showing the internal structure of one embodiment of the present invention.
Figure 11:
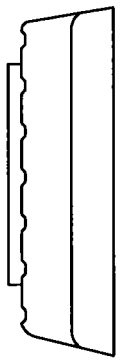
FIG. 11 is a side elevation view of FIG. 9.
Figure 9:
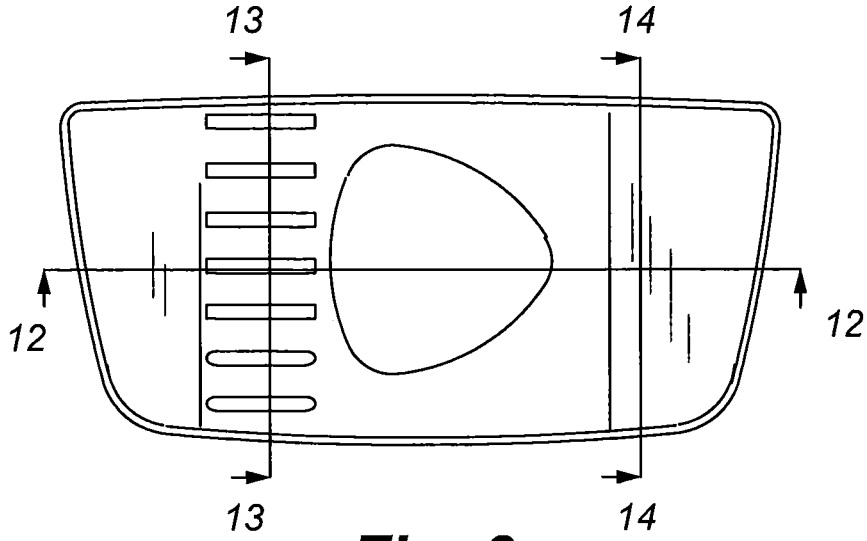
FIG. 9 is a top plan view of a cradle.
Figure 10:
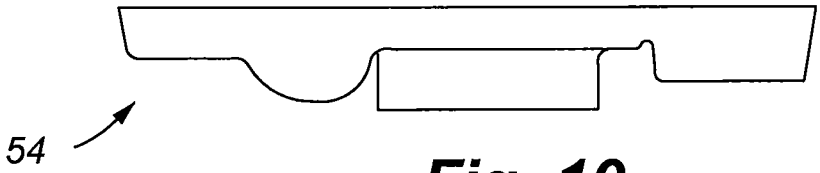
FIG. 10 is a front elevation view of FIG. 9.
Figure 12:
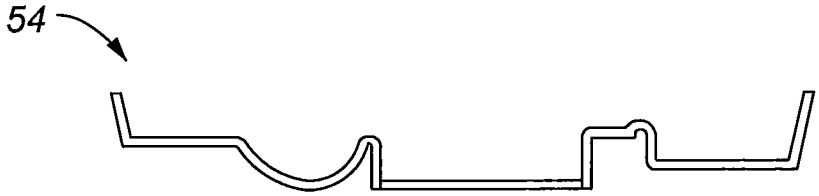
FIGS. 12 is a cross-sectional view of FIG. 9.
Figure 13:
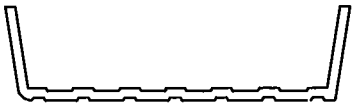
FIGS. 13 is a cross-sectional view of FIG. 9.
Figure 14:
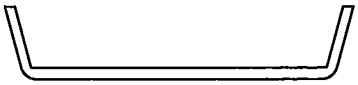
FIGS. 14 is a cross-sectional view of FIG. 9.

To assist in the understanding of the present invention the following list of components and associated numbering found in the drawings is provided herein:

| Component | # |
|---|---|
| Backpack | 2 |
| External panels | 6 |
| Flap | 10 |
| Zipper | 14 |
| Zipper pull | 18 |
| Additional zipper | 22 |
| Web | 26 |
| Bottom panel | 30 |
| Strap | 34 |
| Rear panel | 38 |
| Ring | 42 |
| Attachment point | 46 |
| Pockets | 50 |
| Cradle | 54 |
| Wall | 58 |
| Tube | 62 |
| Lens holder | 66 |
| Lens holder sidewalls | 70 |
| Horizontal wall | 74 |
| Side opening | 78 |
| Laptop computer storage compartment | 82 |
| Belt | 86 |
| Clip | 90 |
| Holster | 102 |
| Hinge | 106 |
| Foam block | 110 |
| Belt loop | 114 |
| Storage case | 118 |
| Tilt out lens holder | 122 |
| Connector | 128 |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-18, a camera storage case of one embodiment of the present invention is shown. Embodiments of the present invention are integrated into a backpack 2 that includes a plurality of external panels 6 and a selectively openable flap 10. The flap 10 is selectively interconnected to the external panels 6 with, preferably, a zipper 14 to provide access into the interior portion of the backpack 2. One skilled in the art will appreciate that similar interconnection mechanisms may be employed, such as ziplocs, snaps, magnets etc. The zipper 14 is interconnected to zipper pulls 18 that allow for easy opening of the backpack 2. In the embodiment shown, an additional zipper 22 is employed on the center of the flap 10 to provide enhanced access to the interior portion of the storage case. A plurality of securing locations or webs 26 may also be employed. The storage case may also include a rigid or semi-rigid bottom panel 30, preferably made of a shock-absorbing material, to protect the contents of the backpack if it is dropped onto a hard surface. In the embodiment shown, and as shown in the other depictions of backpacks 2 provided herein, a plurality of straps 34 are used for securement of the backpack 2 to a user's shoulders. A rear panel 38 stabilizes the backpack 2 against a user's back. Further, a ring 42 may be provided to receive a carabineer or to facilitate carrying of the backpack 2. An attachment point 46 may also be provided to attach other equipment or supplies. In addition, a plurality of pockets 50 may also be employed on the exterior and interior of the backpack 2 shown.

Referring now to FIGS. 7-14, the cradle 54 and internal structure of one embodiment of the storage case is shown. The cradle 54 is preferably made of a rigid or semi-rigid material, such as molded EVA foam and is designed to separate the camera and the lens from the walls 58 of the storage case. The cradle 54 is adapted to prevent twisting and/or sliding of the stored camera within the case. One skilled in the art will also appreciate that the cradle 54 may be made from, partially or exclusively, a softer foam material that selectively conforms to the shape of a camera. The cradle 54 of one embodiment of the invention has a shape commiserate with the shape of common SLR cameras. A tube 62 is preferably associated with the cradle 54 that receives and protects an interconnected lens of the camera when it is stored in a lens-down configuration. The tube 62 may include a bottom surface, or alternatively, be open ended to allow access to the lens. A plurality of lens holders 66 may also be included that are selectively interconnected, or otherwise associated, to the inner walls 58, tube 62, cradle 54, and/or panels 6, 30, 38 of the camera case.

Figure 15:
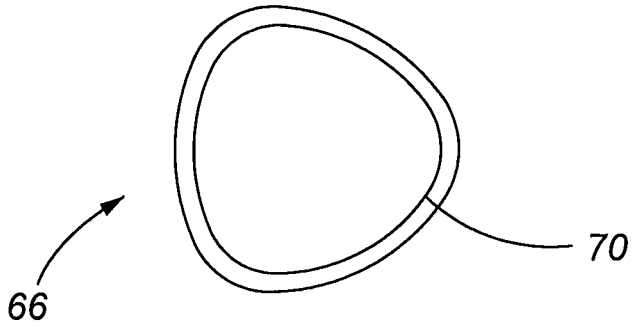
FIG. 15 is a top elevation view of a lens holder of one embodiment of the present invention.
Figure 16:
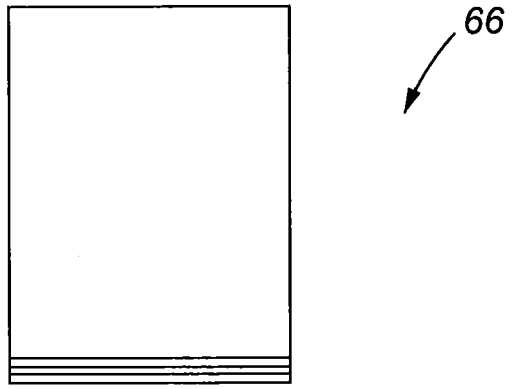
FIG. 16 is a side-elevation view of FIG. 15.
Figure 17:
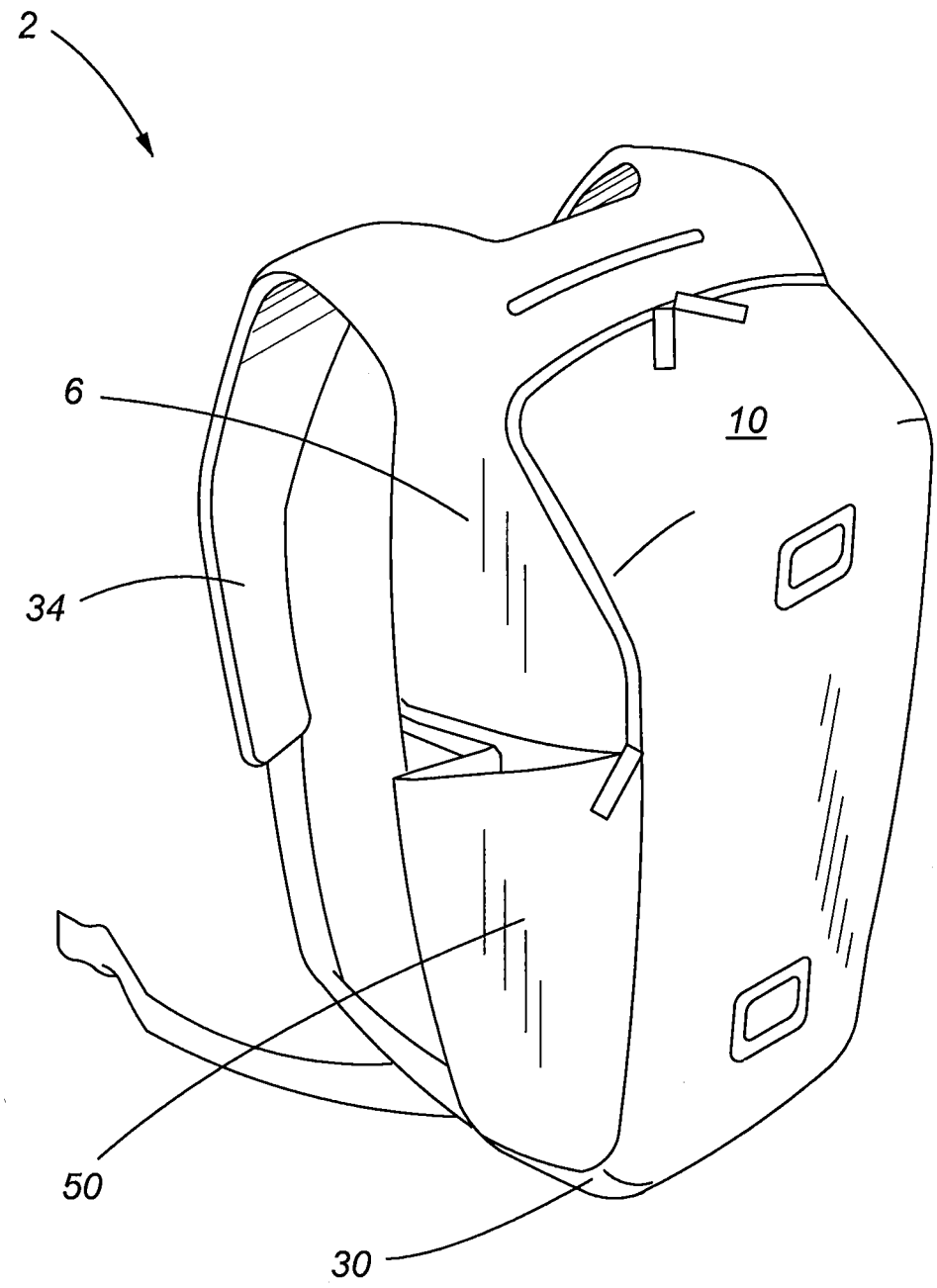
FIG. 17 is a perspective view of another embodiment of the present invention, which is a smaller version of that shown in FIG. 1.
Figure 18:
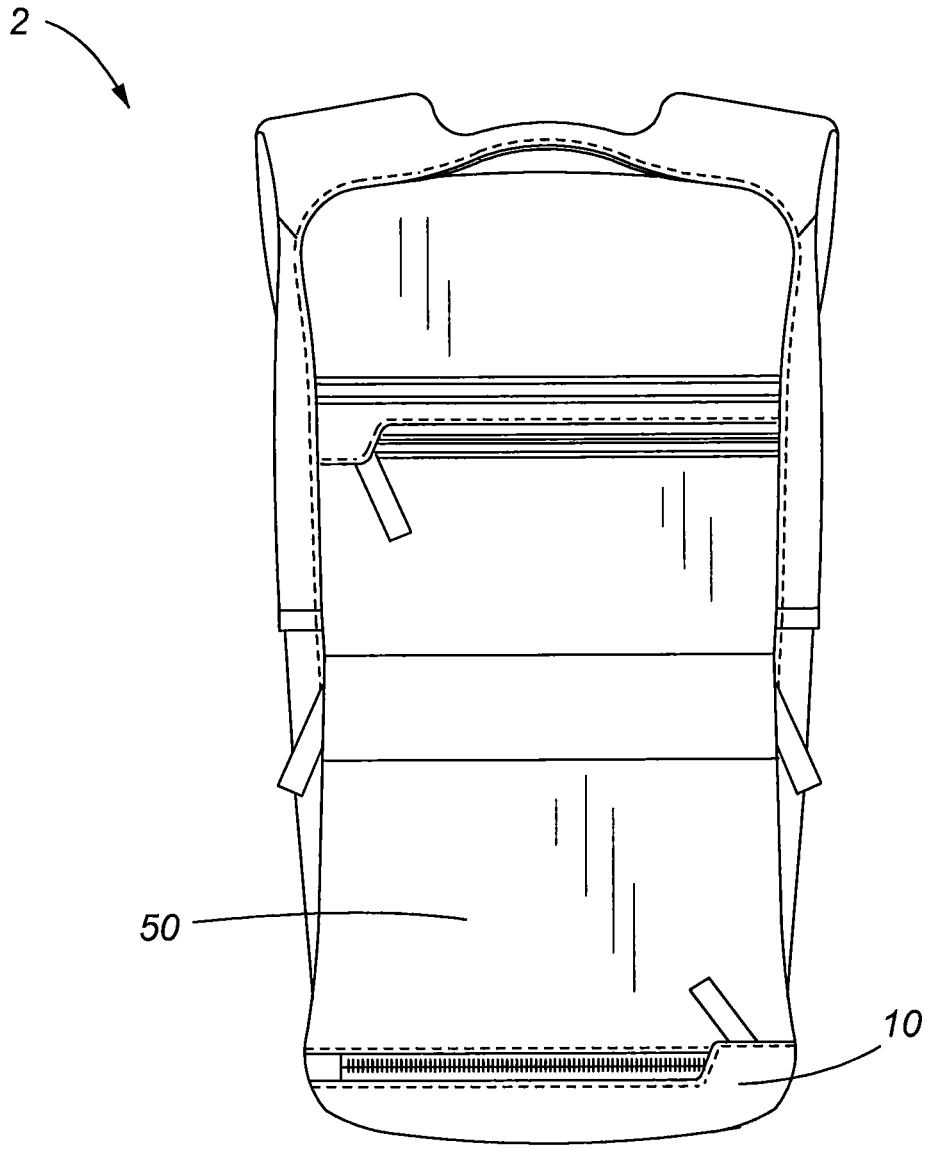
FIG. 18 is a front elevation view of FIG. 17 shown in an open configuration.
Figure 19:
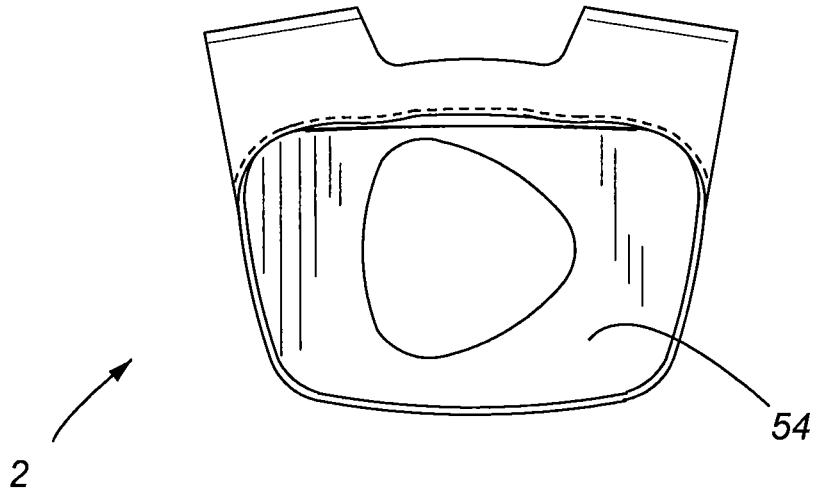
FIG. 19 is a top plan view of FIG. 17 showing the cradle.
Figure 20:
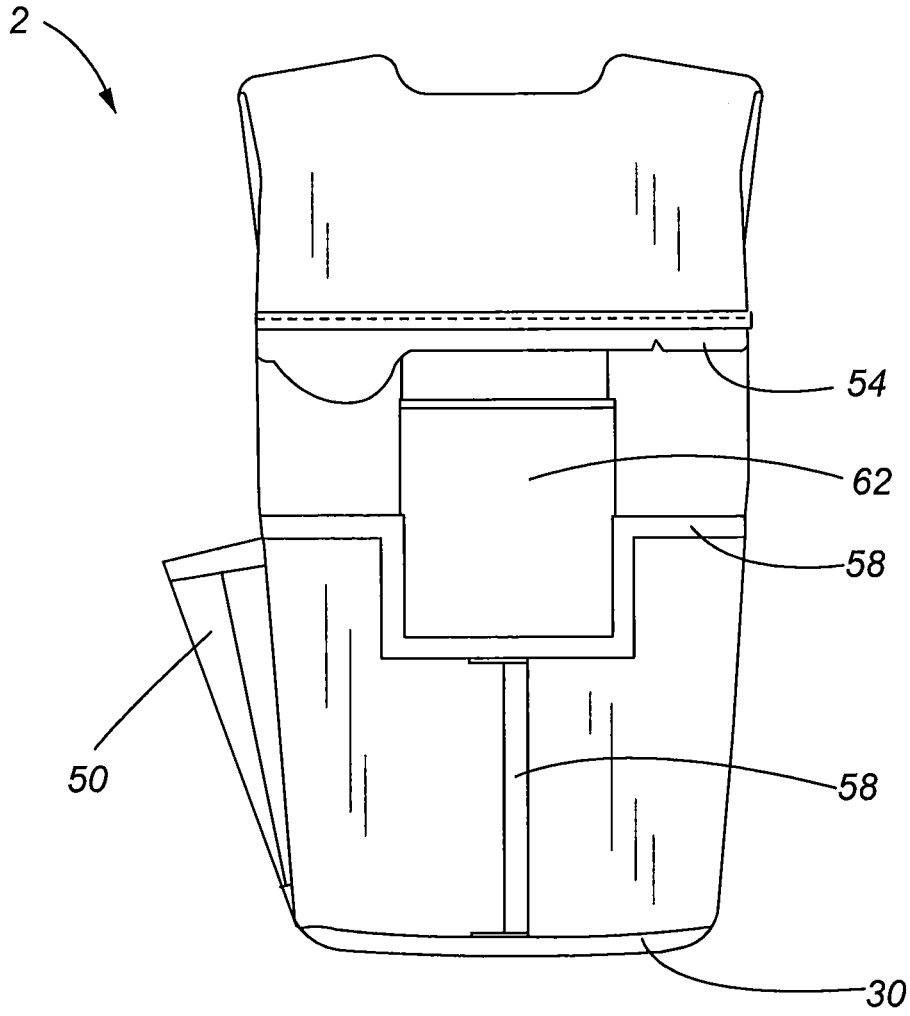
FIG. 20 is a front view of FIG. 17 showing the internal configuration of the back pack.

Referring now to FIGS. 15-16, a lens holder 66 is shown. Embodiments of the present invention employ at least one lens holder 66 that is constructed of a generally triangular shape, although one skilled in the art will appreciate that other geometric shapes may be employed. This shape allows for the selective removal of lenses with various dimensions since the corners of the triangular wall will provide space to allow a user to access the lens. It is envisioned that the lens holder sidewalls 70 are made of a compliant material that will conform to, secure and protect a stored lens. The lens holders 66 may include a selectively interconnected lid (not shown).

Referring now to FIGS. 17-20, another embodiment of the present invention is shown. This embodiment of the present invention is similar to those previously described such that it is comprised of external panels 6, a bottom panel 30, and a rear panel 38 that define a storage area that is selectively accessible by a flap 10. In addition, a plurality of pockets 50 may also be employed on the exterior and interior of the backpack 2 shown. One skilled in the art will appreciate that backpacks 2 of this type are suited for hiking and/or biking and may also employ an interior compartment for holding a water storage and delivery device, such as a CamelBak®. This embodiment of the present invention also includes, with reference to FIGS. 19 and 20, a cradle 54 and tube 62 combination for the receipt of an SLR camera. A plurality of selectively adjustable walls 58 may also be employed to define and organize the interior storage space.

Figure 21:
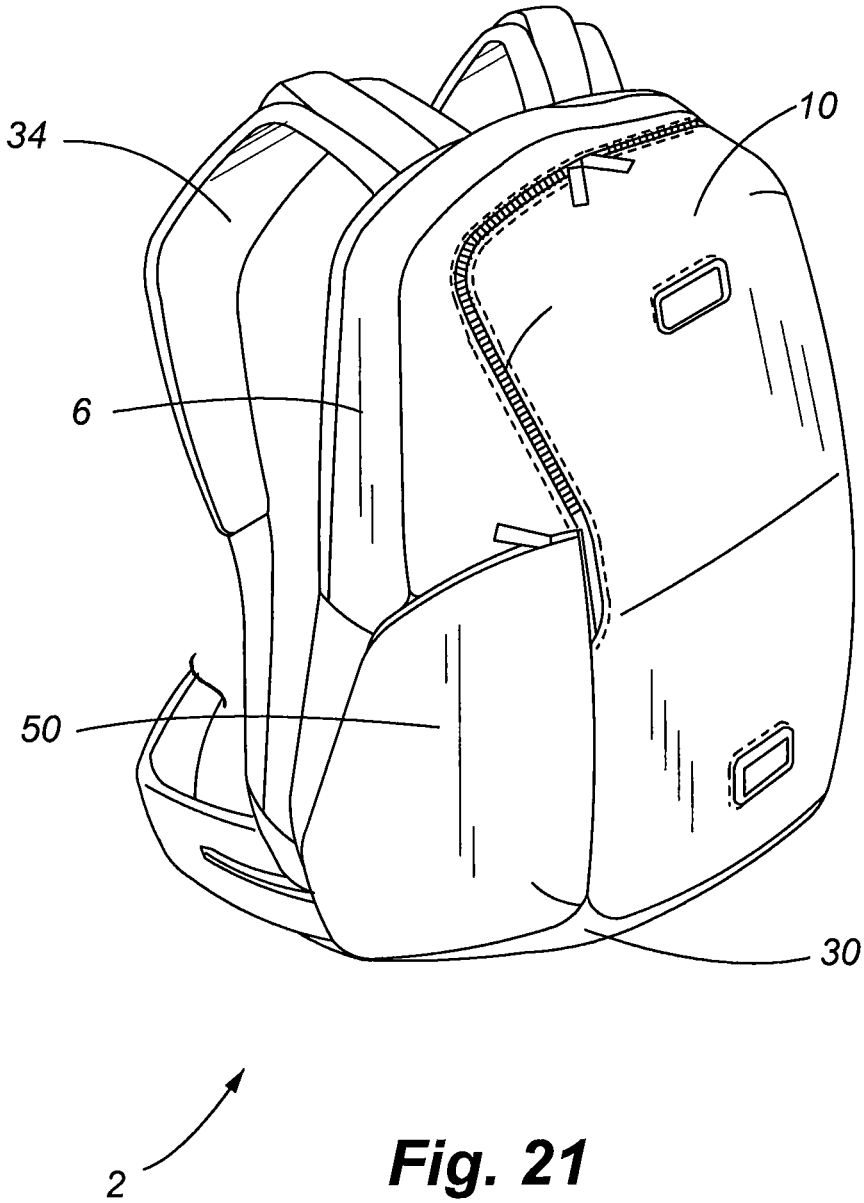
FIG. 21 is a perspective view of yet another embodiment of the present invention, which is larger than that shown in FIG. 1.
Figure 22:
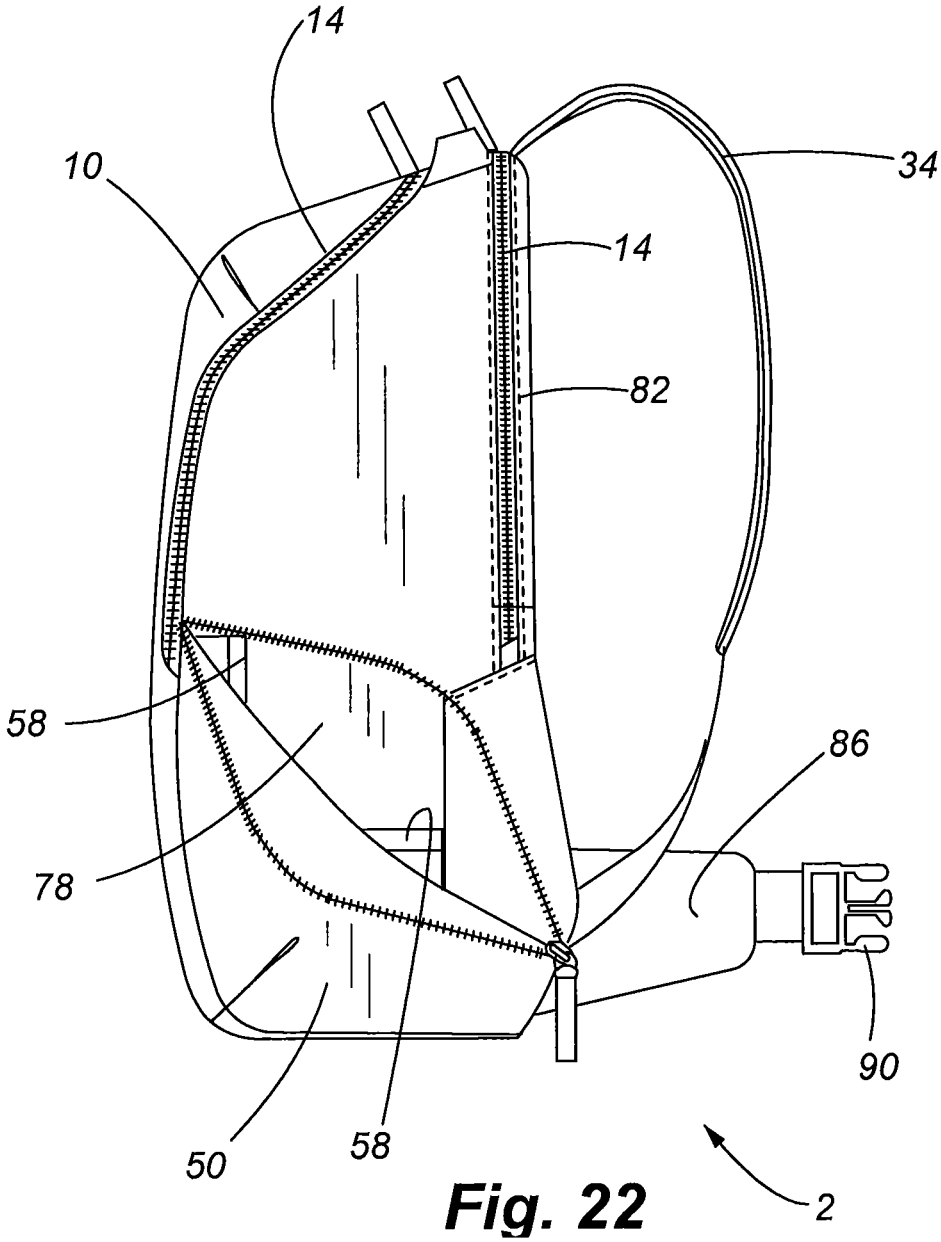
FIG. 22 is a side elevation view of FIG. 21 showing a laptop storage compartment.

Referring now to FIGS. 21 and 22, another storage case is provided herein. The storage case is integrated into a large backpack 2 that is generally defined by a plurality of external panels 6 and a bottom panel 30. A flap 10 is interconnected to the panels via a zipper 14, for example, to provide access to the stored components. With reference to FIG. 22, this embodiment of the present invention also may include a side opening 78 to allow selective accessibility to the lower portion of the storage case. A plurality of selectively adjustable walls 58 are also included. Further, a laptop computer storage compartment 82 is provided. A plurality of straps 34 are used for securement of the backpack to a user's shoulders. In addition, for additional comfort and support, a belt 86 and clip 90 combination may be used for fastening around a user's waist.

Figure 23:
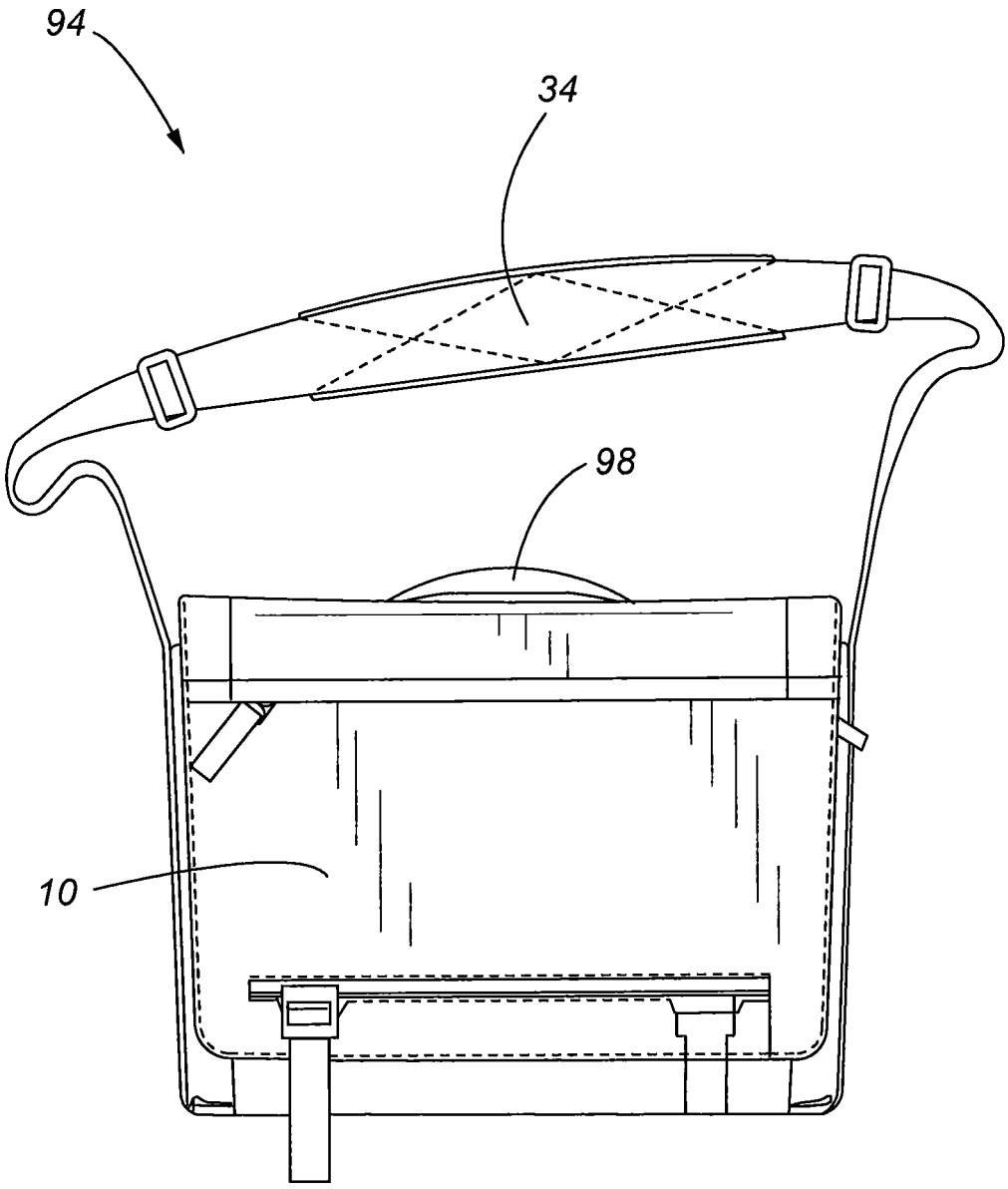
FIG. 23 is a front elevation view of another embodiment of the present invention that is in the form of a messenger bag.
Figure 24:
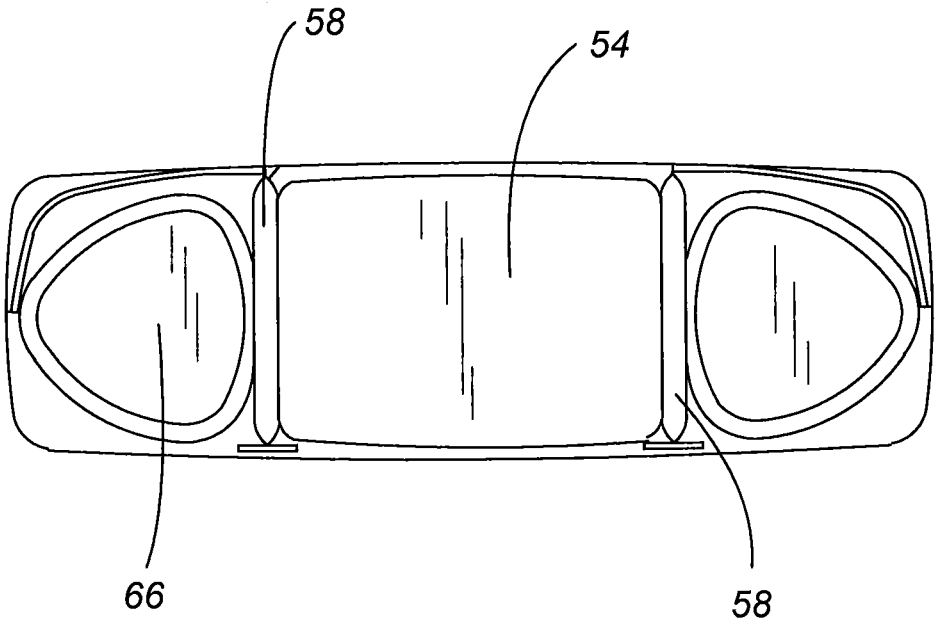
FIG. 24 is a top plan view of FIG. 23 showing the internal components.

Referring now to FIGS. 23-24, yet another embodiment of the present invention is shown that is integrated into a messenger bag 94. The messenger bag 94 is generally in the shape of a briefcase having a handle 98 and a strap 34. A flap 10 is included for selective access to the interior storage space of the messenger bag 94. FIG. 24 shows that the interior storage space includes a cradle 54 and has a plurality of selectively adjustable dividing walls 58 and lens holders 66 as described above.

Figure 25:
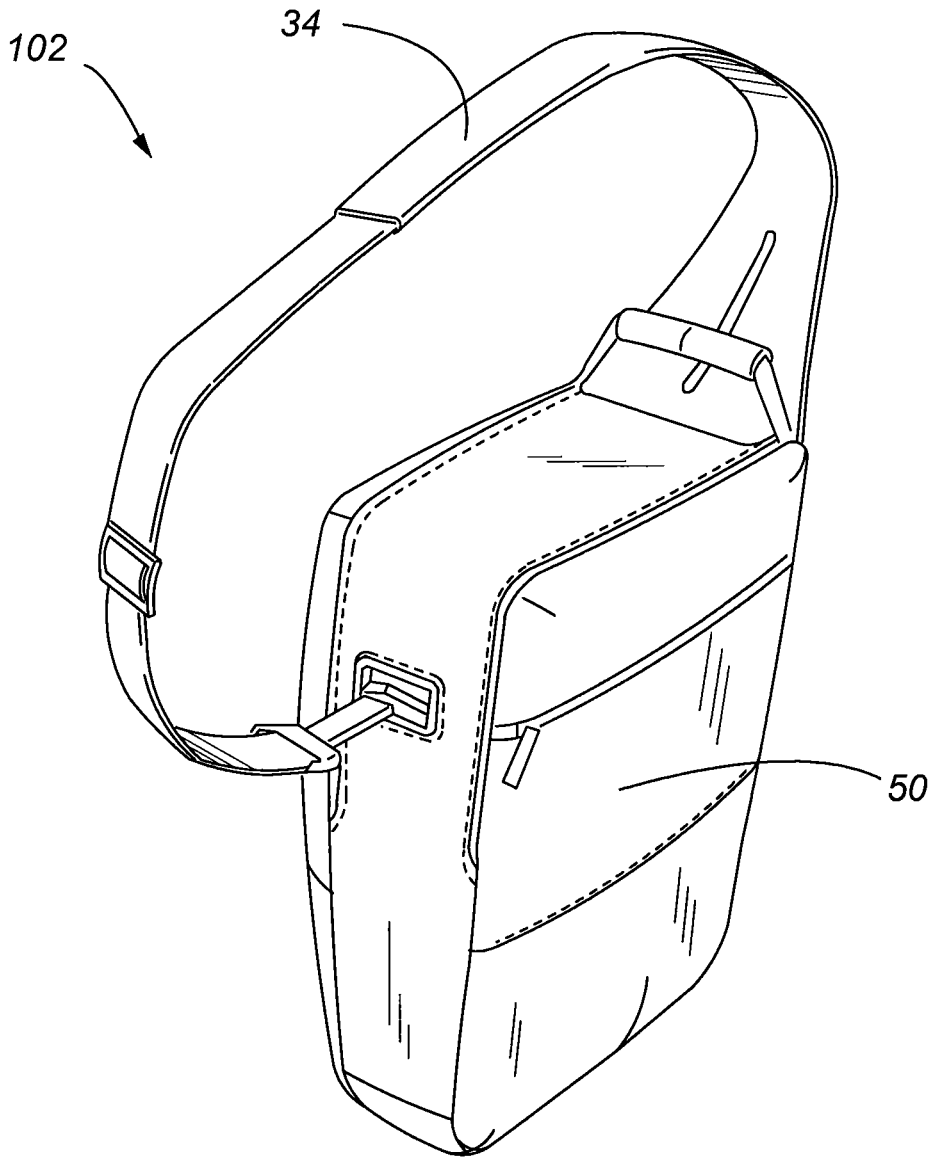
FIG. 25 is a perspective view of another embodiment of the present invention that is in the form of a holster.
Figure 26:
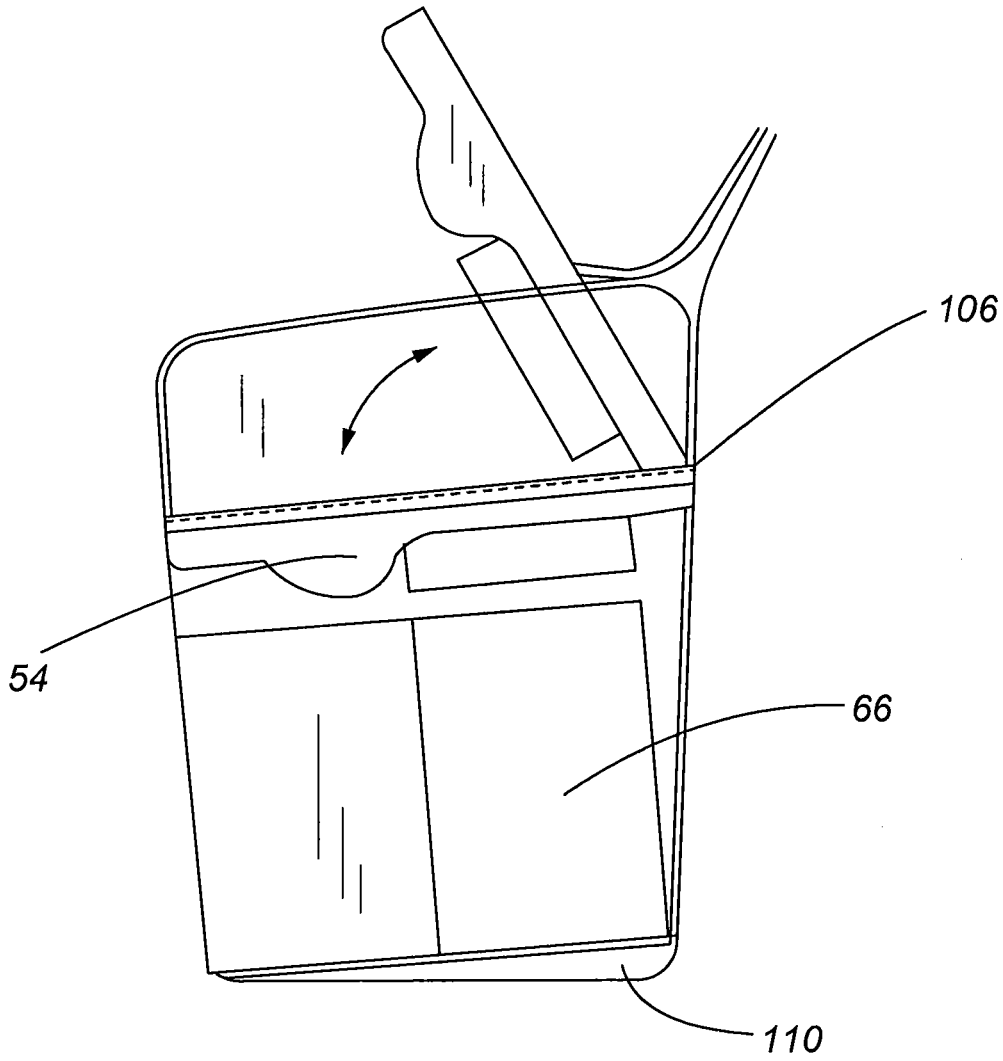
FIG. 26 is a side cross-sectional view of the internal components of the holster shown in FIG. 27.

Referring now to FIGS. 25-26, another embodiment of the present invention is shown that is in the shape of a holster 102. This embodiment of the present invention may also include a shoulder strap 34. In addition, the cradle 54 of this embodiment of the present invention, and the other embodiments of the present invention described herein, may be operably interconnected via a hinge 106 to an inner surface of the holster 102 in order to provide selective access to various items such as lens holders 66 stored beneath the cradle 54. In one embodiment of the present invention, the lens holders 66 are held in place by a foam block 110. The foam block 110 also absorbs shocks to protect the stored items of the holster 102 if it should be inadvertently dropped onto a hard surface.

Figure 27:
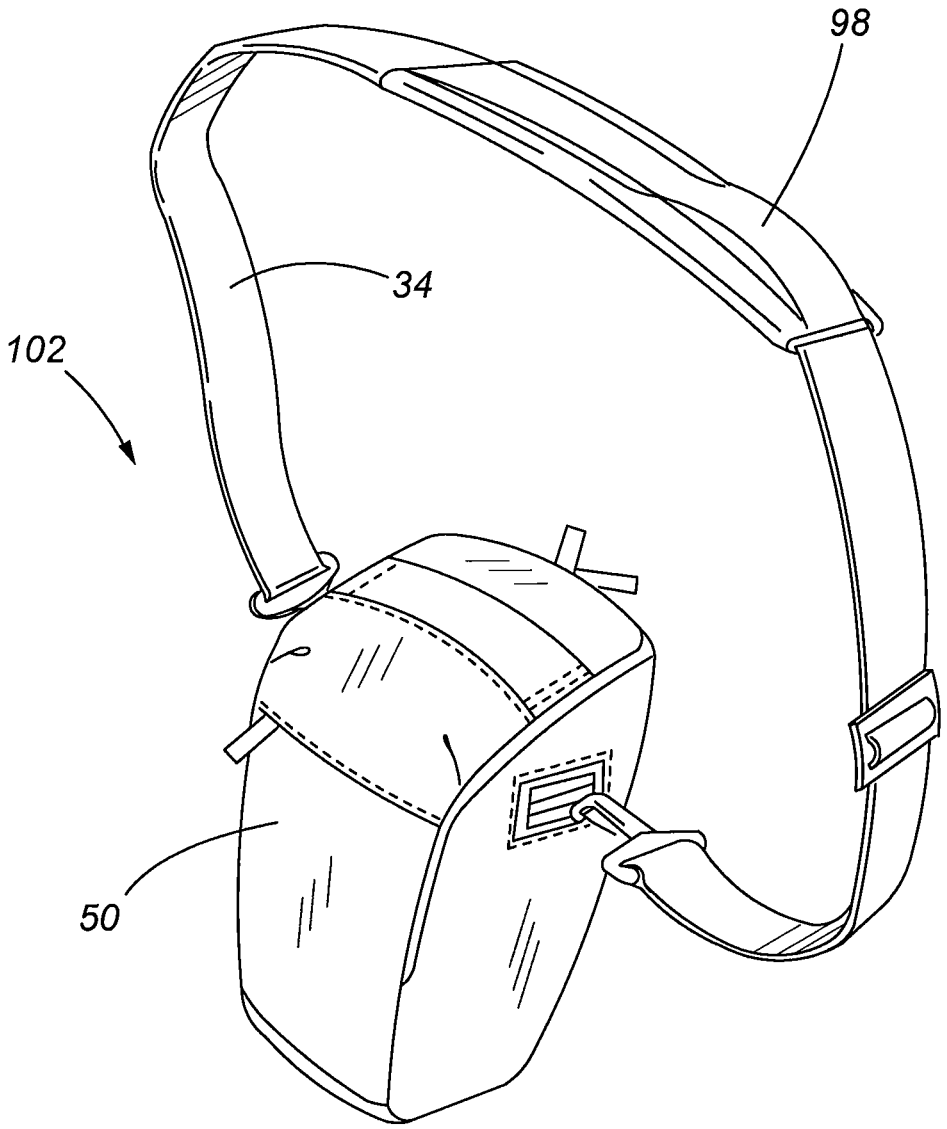
FIG. 27 is another embodiment of the present invention similar to that shown in FIG. 27.
Figure 28:
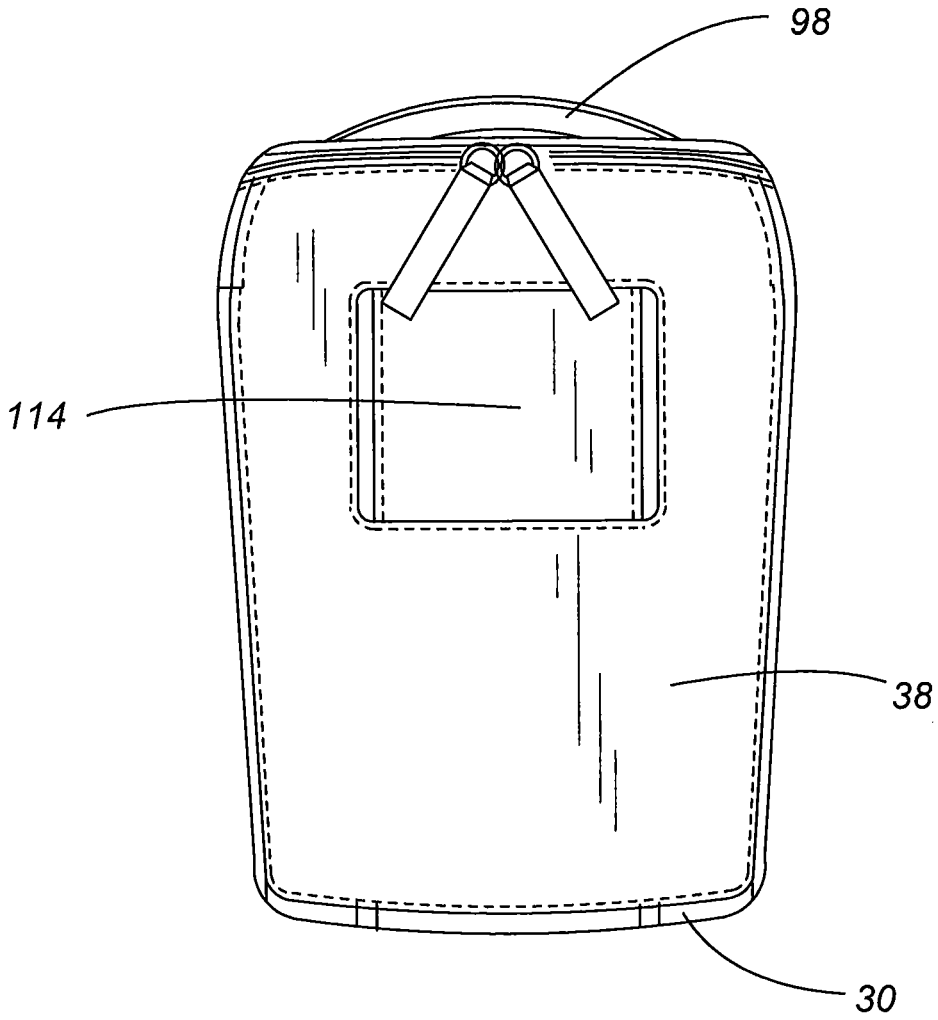
FIG. 28 is a rear elevation view of the embodiment of the present invention shown in FIG. 29.
Figure 29:
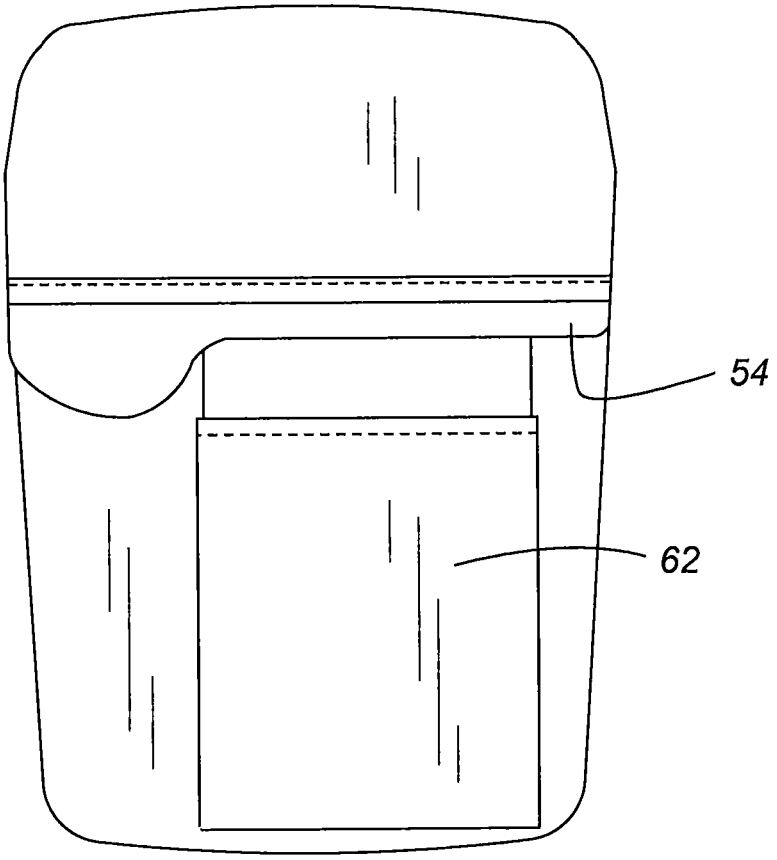
FIG. 29 is a side cross-sectional view of the holster shown in FIG. 27.

Referring now to FIGS. 27-29, yet another embodiment of the present invention is provided herein where the case is shaped as a holster 102. This embodiment of the present invention employs a strap 34 having a handle 98 and may employ a plurality of pockets 50 positioned on the external panels 6 of the storage case. The internal structure of the holster 102 may include a cradle 54 and a tube 62. Further, a belt loop 114 may be added to the storage case, preferably on the rear panel 38 of the holster 102. One skilled in the art will appreciate that a belt clip or any other similar item may be utilized for interconnection to a user's clothing, or to another bag.

Figure 30:
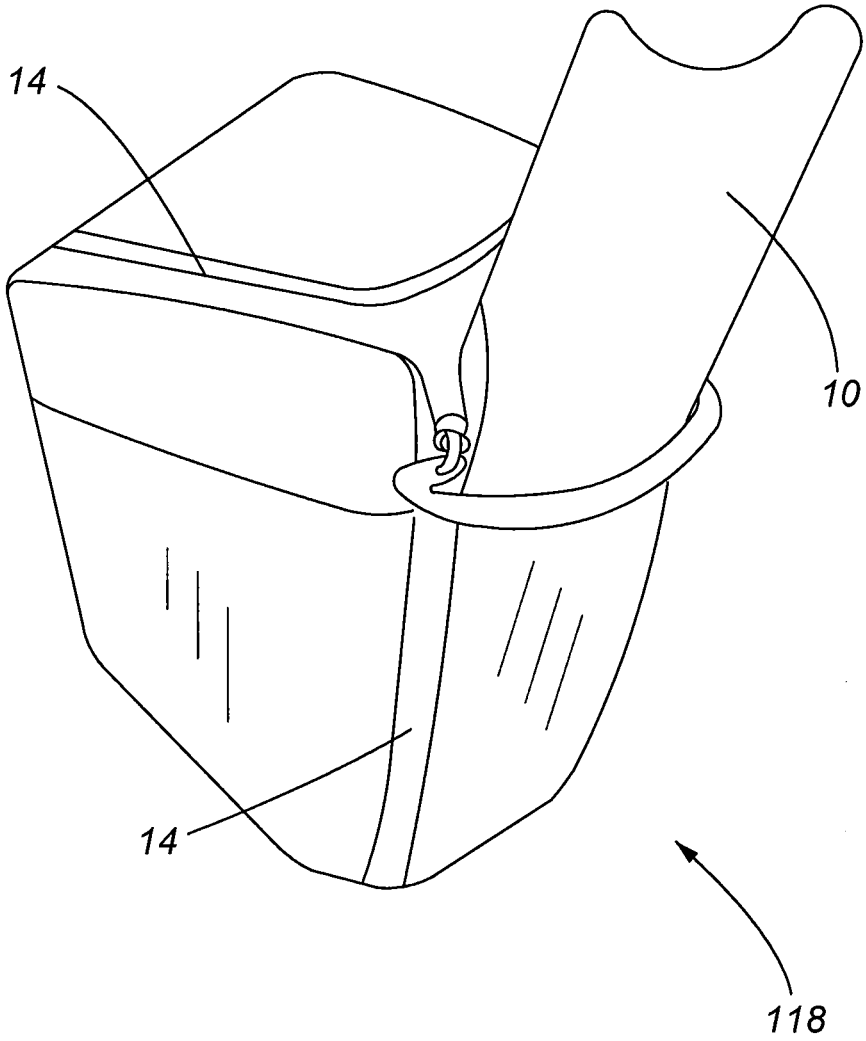
FIG. 30 is a front perspective view of a storage case of another embodiment of the present invention that uses a tilt out lens holder.
Figure 31:
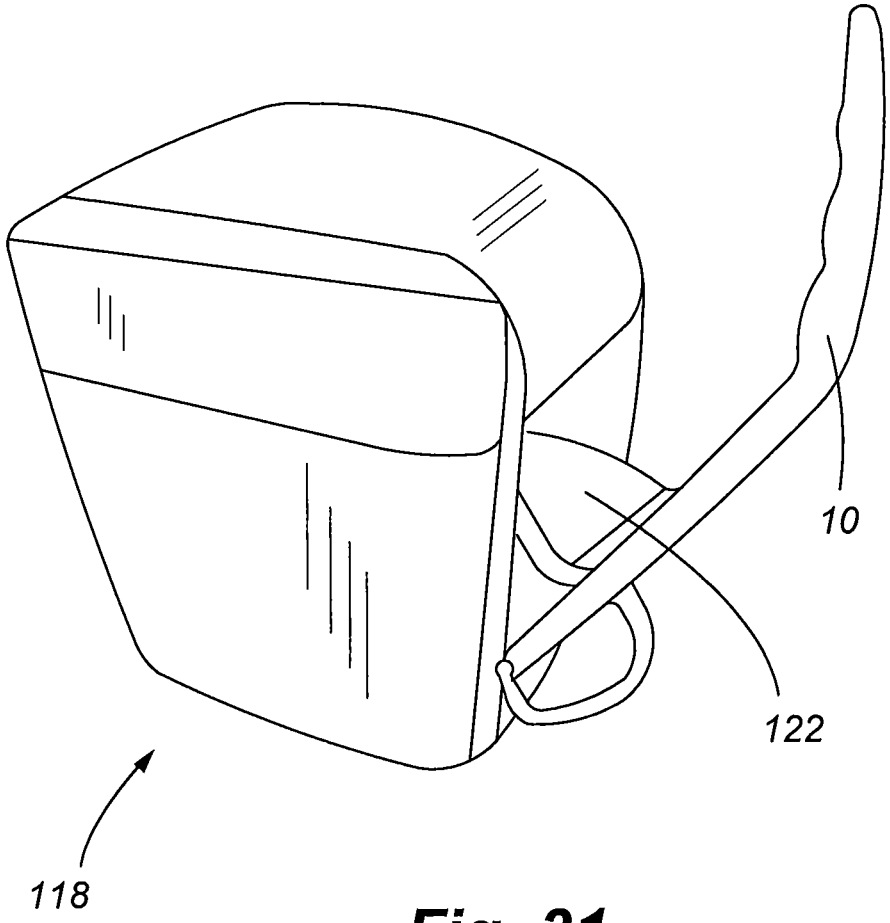
FIG. 31 is a front perspective view of the storage case shown in FIG. 30.
Figure 32:
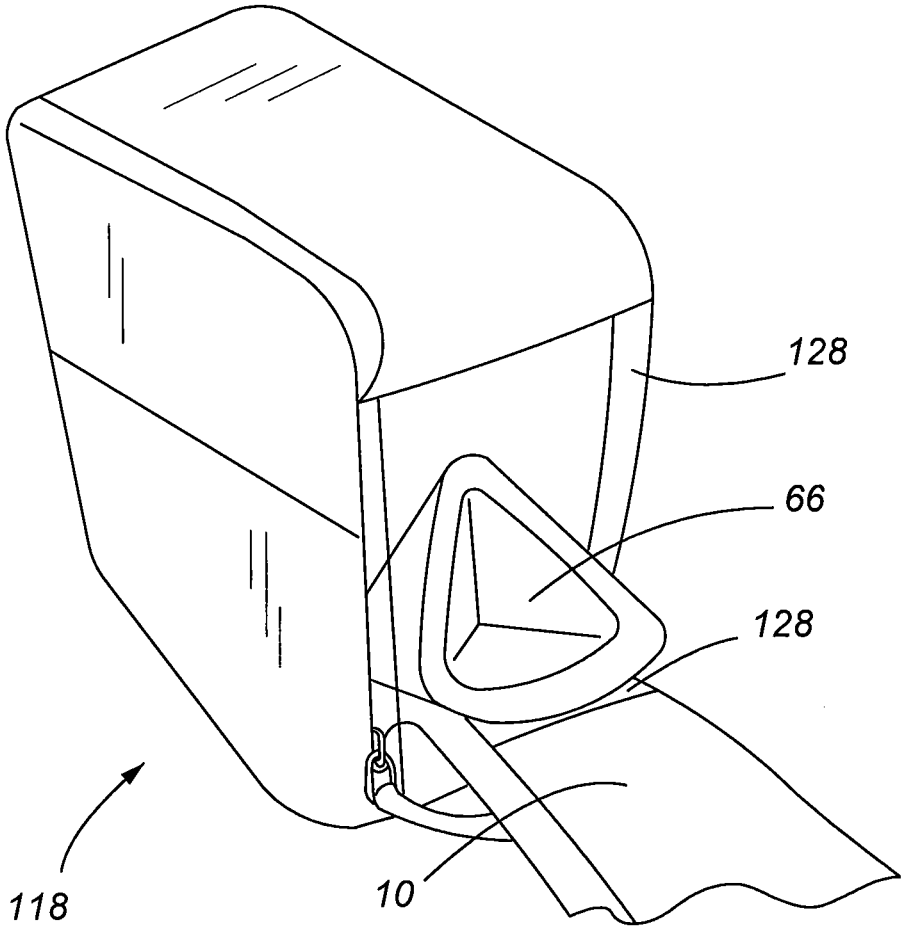
FIG. 32 is another front perspective view of the storage case shown in FIG. 30.

Referring now to FIGS. 30-32, a storage case 118 employing a tilt out lens holder 122 is provided. More specifically, the flap 10 of this embodiment is selectively interconnected to the storage case 118 via a hook and loop material (not shown). The flap 10 may also include a connector 128, such as a hook and loop material, that is adapted to receive a similar connector 128 located on the lens holder 66. In operation, when the user opens the flap 10 and deflects it outwardly, the lens holder 66 will additionally tilt outwardly to provide enhanced access to the stored lens. One of skill in the art will appreciate that this feature can be employed in any of the embodiments of the present invention described and shown herein.

Referring again generally to FIGS. 1-31, embodiments of the present invention are sewn together with known techniques and may employ lycra, closed cell (EVA) foam, low-density brushed lycra, nylon, and other materials that may be water-resistant or water-proof. Some embodiments employ rigid, molded EVA foam that conforms generally to the envelope of an SLR camera. Alternatively, the foam cradle may be customized to receive a specific camera, which enhances storage and protection of the same.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A storage case adapted to receive a camera with an extending lens, comprising:

a backpack having a plurality of external panels, including a left panel, a right panel, a bottom panel, a rear panel, and a selectively opening front panel;

a plurality of straps interconnected to at least one of said rear panel, said right panel, said left panel, said bottom panel and said top panel;

a cradle interconnected to at least one of said rear panel, said left panel and said right panel, said cradle selectively interconnected to said left and said right panels by a hook and loop material;

a tube extending from a lower surface of said cradle and substantially parallel with said left panel and said right panel, said tube generally positioned in a downward direction to encapture the lens of the camera and generally separated from the bottom panel by at least two selectively adjustable walls positioned with a hook and loop material and extending between said left panel and said right panel within a lower interior portion of said back pack, wherein varying sizes of compartments can be formed;

at least one lens holder provided beneath said cradle for conforming to, securing and protecting a lens, said at least one lens holder provided adjacent to and positioned substantially perpendicular to said tube.

2. The storage case of claim 1, wherein said at least one lens holder is a plurality of selectively adjustable lens holders positioned in the interior of said storage case, said lens holders selectively interconnected to one of said external panels by a hook and loop material.

3. The storage case of claim 1, further comprising at least one external pocket interconnected to at least one of said external panels.

4. The storage case of claim 1, further comprising a laptop computer storage compartment associated with said rear panel.

5. The storage case of claim 1, further comprising a plurality of selectively adjustable walls interconnected to an interior surface of said external panels with a hook and loop material.

6. The storage case of claim 5, further comprising a closure interconnecting said left panel to said front panel and said fight panel to said front panel, thereby providing enhanced selective access to the interior of said storage case.

7. A carrying case having an upper end, a lower end and adapted for storing a camera with a lens extending therefrom and accessory items, comprising:

a means for securing a camera interconnected to said case wherein said means for securing includes a foam cradle suited for the camera;

a means for supporting a lens interconnected to said means for securing a camera, said means for supporting the lens comprising a tube extending from a lower surface of said means for securing a camera and said tube oriented so that an interconnected lens of the camera is positioned substantially downwardly;

means for securing additional lens within said case, said means for securing additional lens comprising at least one additional lens holder provided beneath said means for securing a camera and said means for securing additional lens used for conforming to, securing and protecting an additional lens, said at least one additional lens holder provided adjacent to and positioned substantially perpendicular to said means for supporting a lens;

means for grasping said case;

means for adjustably storing a plurality of camera accessories within said case; and means for securing other items to said case.

8. The carrying case of claim 7, wherein said means for supporting the lens is a tube adapted to surround substantially the entire circumferential surface of the lens.

9. The carrying case of claim 7, wherein said cradle is constructed at least partially of an ethylene-vinyl acetate (EVA) material.

10. The carrying case of claim 7, wherein said means for grasping said case is at least one of a strap and a handle.

11. The carrying case of claim 7, wherein said means for securing additional lens comprises a triangularly shaped holder affixed to an interior portion of said case by a hook and loop material.

12. The carrying case of claim 7, wherein said means for adjustably storing a plurality of camera accessories within said case comprises a plurality of selectively adjustable dividing walls that create storage compartments of varying dimensions.

13. The carrying case of claim 7, wherein said carrying case is at least one of a backpack, a messenger bag, and a holster.

14. The carrying case of claim 7, wherein the cradle is made of a compliant material that provides impact protection to the camera.

15. The carrying case of claim 14, wherein said compliant material is comprised of at least one of a nylon, a rubber, a leather, an artificial leather, and a foam.

16. A storage case adapted to receive a camera and at least one lens extending outwardly from a body of the camera, comprising:

a backpack comprising at least a front panel, a rear panel, two side panels and a bottom panel;

a plurality of straps interconnected to said backpack;

a selectively openable closure interconnected to an upper portion of said back pack;

a cradle interconnected to an interior surface of said back pack, said cradle generally possessing the shape of the camera;

a tube extending from a lower portion of said cradle and substantially parallel to said two side panels, said tube generally positioned in a downward direction to accommodate the lens of a camera;

a plurality of selectively adjustable walls positioned within an interior portion of said back pack with a hook and loop material and extending between and substantially perpendicular to said two side panels, wherein varying sizes of compartments can be formed;

a plurality of selectively adjustable lens holders positioned within said storage case, said lens holders selectively interconnected to an interior surface of the back pack by a hook and loop material and positioned below said cradle and extending in a direction substantially perpendicular to the tube; and at least one of the plurality of selectively adjustable walls selectively interconnected to a second adjustable wall.

17. The storage case of claim 16, further comprising a plurality of webs interconnected to at least one of said external panels.

18. The storage case of claim 16, wherein said bottom panel is padded to provide impact protection.

19. The storage case of claim 16, wherein said straps are generally made of nylon and said cradle is generally made of an ethylene-vinyl acetate foam.

20. The storage case of claim 19 further comprising at least one external pocket interconnected to at least one of said external panels and at least one internal pocket interconnected to at least one inwardly facing surface of said front panel.

* * * * *